United States Patent [19]

van den Haak

[11] Patent Number: 4,706,595

[45] Date of Patent: Nov. 17, 1987

[54] ANCHOR

[76] Inventor: Rob van den Haak, Allegro 114, 2925 BG Krimpen a/d Ijssel, Netherlands

[21] Appl. No.: 725,381

[22] Filed: Apr. 22, 1985

Related U.S. Application Data

[63] Continuation of Ser. No. 645,518, Aug. 28, 1984, abandoned, which is a continuation of Ser. No. 304,506, Sep. 22, 1981, abandoned.

[30] Foreign Application Priority Data

Sep. 25, 1980 [NL] Netherlands ..... 80 05341

[51] Int. Cl.[4] ..... B63B 21/26

[52] U.S. Cl. ..... 114/301; 114/294

[58] Field of Search ..... 114/294, 301, 304, 305, 114/306-311

[56] References Cited

U.S. PATENT DOCUMENTS

| | | | |
|---|---|---|---|
| 1,356,481 | 10/1920 | Windle | 114/303 |
| 2,368,942 | 2/1945 | Northrop | 114/306 |
| 3,964,421 | 6/1976 | van den Haak | 114/309 |
| 4,134,355 | 1/1979 | Carruthers | 114/304 |
| 4,154,187 | 5/1979 | Taylor | 114/306 |
| 4,224,892 | 9/1980 | Sandberg | 114/294 |
| 4,397,256 | 8/1983 | Bruce | 114/301 |

FOREIGN PATENT DOCUMENTS

| | | | |
|---|---|---|---|
| 0045556 | 2/1982 | European Pat. Off. | 114/294 |
| 306041 | 2/1933 | Italy | 114/294 |
| 7608728 | 2/1978 | Netherlands | 114/301 |
| 574326 | 1/1946 | United Kingdom | 114/294 |

*Primary Examiner*—Joseph F. Peters, Jr.
*Assistant Examiner*—C. T. Bartz
*Attorney, Agent, or Firm*—Ladas & Parry

[57] ABSTRACT

An anchor having a V-shaped twin shank with its legs composed of flat shapes in planes substantially parallel to the fluke so that the soil moves as through a tunnel for sliding penetration which is kept in a straight course due to stabilizer ear plates at a forwardly opening angle at the rear corners of the fluke.

1 Claim, 22 Drawing Figures

Figure 1:
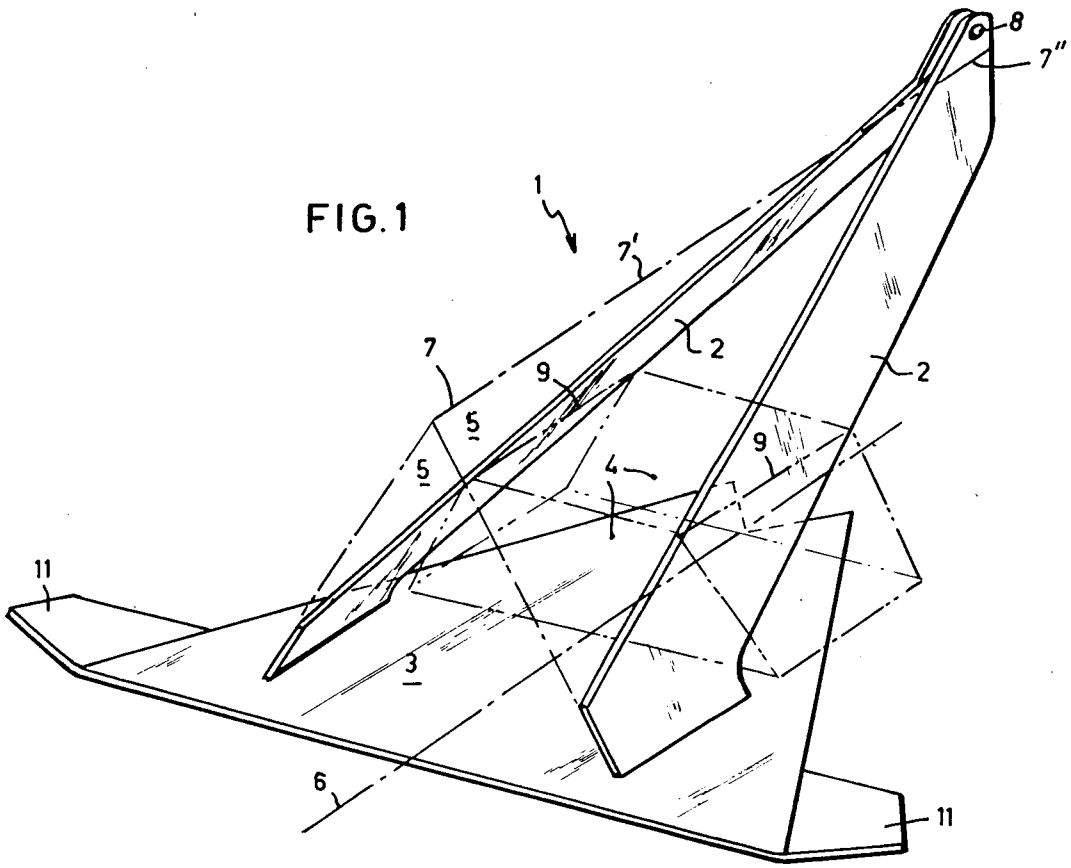

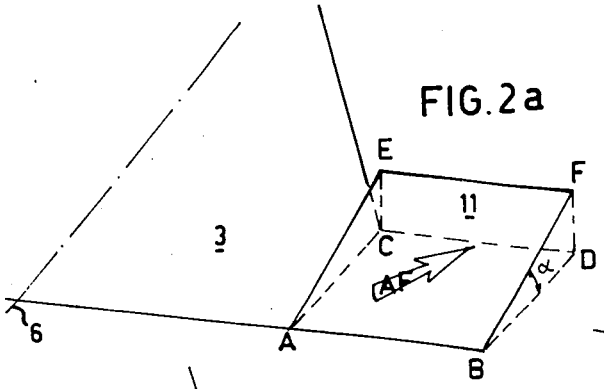
FIG. 2a
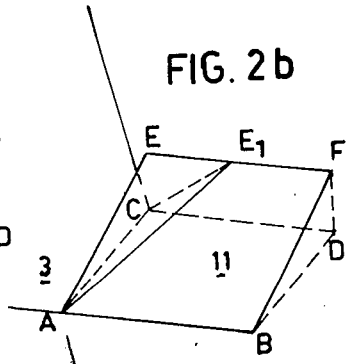
FIG. 2b
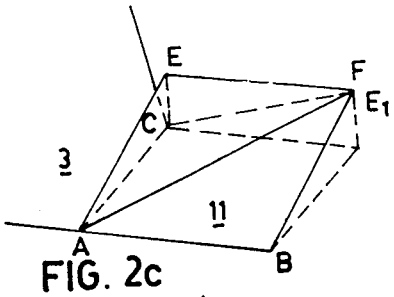
FIG. 2c
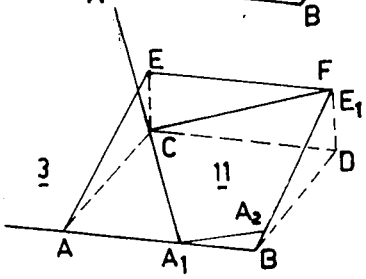
FIG. 2d
FIG. 2e
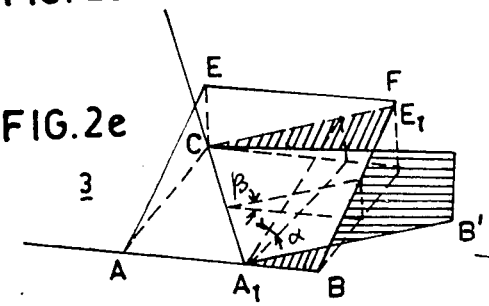
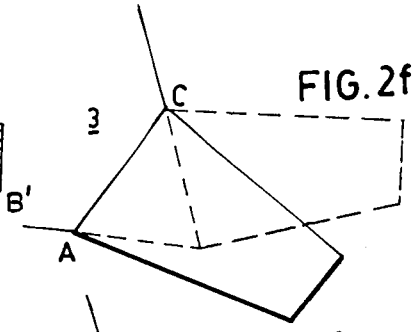
FIG. 2f
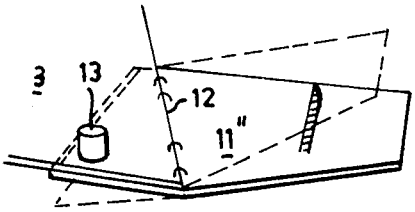
FIG. 3a
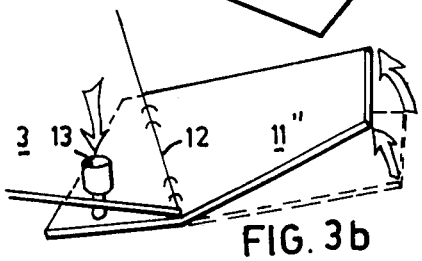
FIG. 3b

ANCHOR

This is a continuation of co-pending application Ser. No. 645,518 filed on Aug. 28, 1984 abandoned which is a continuation of U.S. patent application Ser. No. 304,506 filed on 9-22-81 which was abandoned.

This invention relates to an anchor provided with a fluke to which a V-shaped twin shank is fixedly connected, each shank leg consisting of a wide flat shape.

Such an anchor is known from Dutch patent application No. 7115016 which was published on May 3, 1973. There the holding force of the anchor is increased by a deep penetration but this known anchor has the disadvantage that the shank legs are placed so that, considered in projection perpendicular to the direction in which the fluke penetrates, they present a substantial surface area offering much resistance which impedes the deep penetration.

Said disadvantage is obviated with a V-shaped twin shank according to the present invention, with the shank legs with their wide flat sides being located in planes having an intersecting line substantially parallel to the fluke axis, the arrangement being so that, when penetrating, the soil is to be displaced as through a tunnel of substantially constant cross sectional area. Due to the substantially reduced resistance so experienced, the new anchor can penetrate much deeper and can exert a higher holding force than could be achieved before.

Achievement of said high holding force is to be controlled counting as directive for the position to be given to the shank that the shank legs, parallel to the fluke, reckoned along their height make on average an angle of $0° \pm 9°$ with the fluke axis. Generally the anchor is characterized in that the angle which each shank leg makes with the fluke axis decreases from below to above, but as an also useful alternative in that said angle reckoned along the height of the shank is fully or partially constant. With each of said possible embodiments, when the anchor penetrates, the soil can pass through a tunnel which by staying within the ruled standard for the position of the twin shank offers only little passage resistance. Particularly at the top, just below the anchor shackle, where the shank legs meet, the soil may readily pass whereas the prior anchor at that location would experience a penetration impeding effect because in the prior anchor the intersecting line between the shank leg planes does not extend parallel to the fluke at that location but is directed more vertically thereon, which gives much resistance.

At penetration the straight position of the anchor is maintained by stabilizers at the rear corners of the fluke, each consisting of a sideways offstanding earplate which stands at a forwardly opening vertical angle $\alpha$, thus by the achieved uplift longer maintaining the penetration, as well as offering little resistance to penetration, and the angle $\alpha$ at which the plate stands, parallel to the fluke axis, with respect to the fluke, can be from 15° to 55°, dependent upon the type of soil, while the angle $\beta$ at which the plate stands, perpendicular to the fluke axis, with respect to the fluke, can be from 0° to 38°. This form of stabilizer presents a proper stabilizing action but much less resistance than the stabilizers used in the known anchor which are placed at an angle opening inwardly and rearwardly with respect to the fluke.

The anchor can be used in practically any soil, in various circumstances, as the shank is detachable and adjustable at angles from 28° to 50° for hard and soft soil. In order to be able to set a desired rate of the holding force the stabilizers are adapted to be controlled by means of a sensor so as to reduce the resistance or to increase it when in a certain case the pull on the chain should be restricted or contrary thereto in another case a maximum holding power is required. The sensors are adapted to respond to a force, position or motion function as will be further described.

The penetration and thereby the holding power of the anchor is further increased it is provided with a precutter which can have a length of 40–120% of the shank length. The precutter is provided with a streamline plate to streamline the onflow to the anchor shackle so that the resistance is reduced. The precutter is arranged between the chain and anchor shackles and thus promotes digging-in of the anchor which leads to a deeper penetration. Breaking-out of this anchor which is provided with a precutter is nevertheless simple as just ahead of the streamline plate the precutter has a catch opening for a chaser, and also bringing-out forms no problem as the precutter and the anchor are to be interfitted one into the other so that they can be trailed through and on the water as one whole by the anchor chain.

As a further aspect this invention comprise an anchor rack consisting of a tiltable davit arranged at the deck edge and provided at its lower end with a cradle and at its top with a closable support ring in which the anchor with the precutter are to be stowed.

The invention is described in more detail in the following specification with reference to the drawing wherein illustrative embodiments of the invention are represented.

Figure 4A:
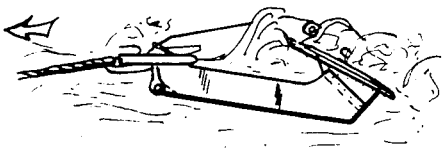
Figure 4B:
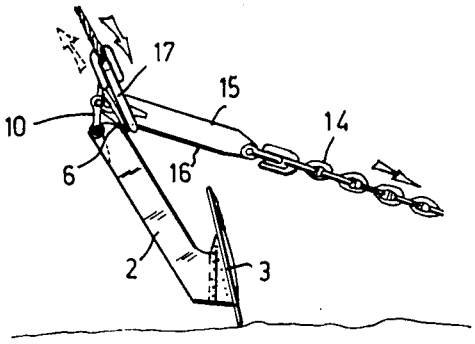
Figure 4C:
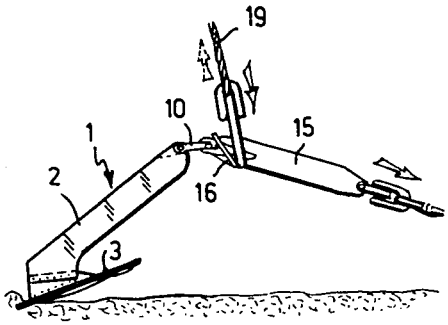
Figure 4D:
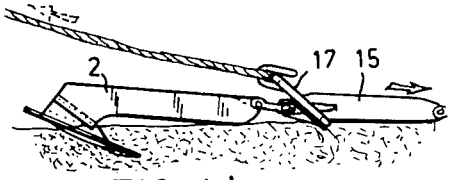
Figure 4E:
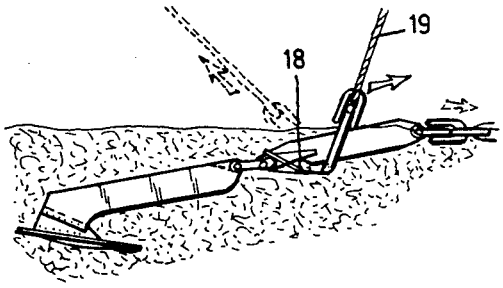
Figure 4F:
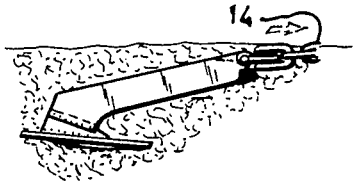

FIG. 1 is a perspective schematic view of the new anchor with V-shaped twin shank, in which particularly the good passage of the soil at penetration of the anchor is illustrated;

FIGS. 2*a–f* show some applicable stabilizer configurations;

FIGS. 3*a, b* show a stabilizer, the position of which can be adjusted by means of a sensor;

FIGS. 4*a–e* show the even better penetration of an anchor with a precutter relative to the anchor without precutter as illustrated in FIG. 4*f;*

Figure 5A:
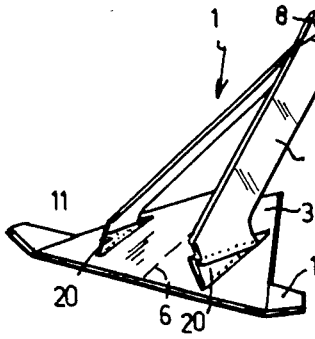
Figure 5B:
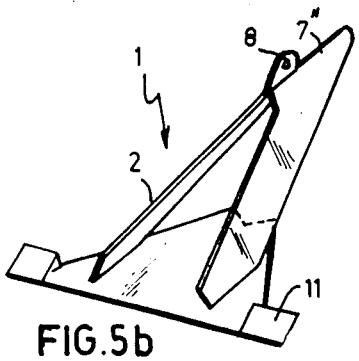
Figure 5C:
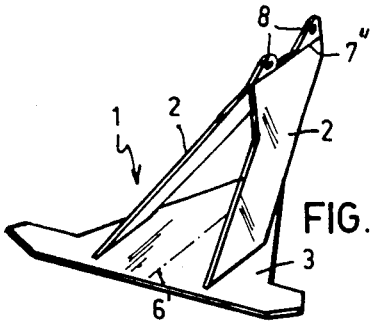
Figure 5D:
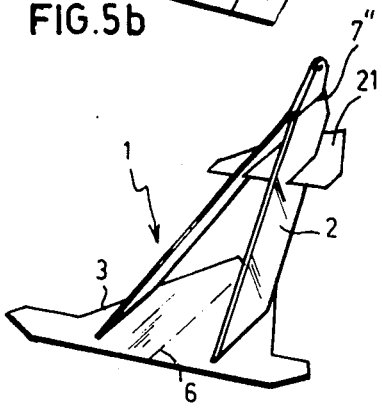
Figure 5E:
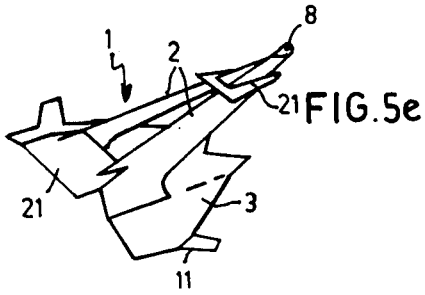
Figure 5F:
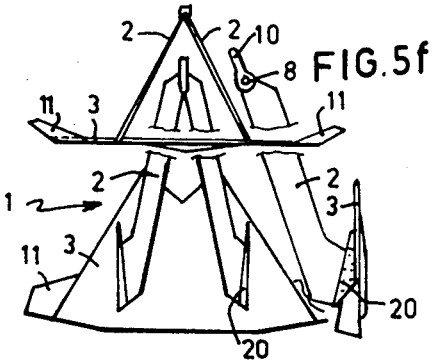
Figure 6:
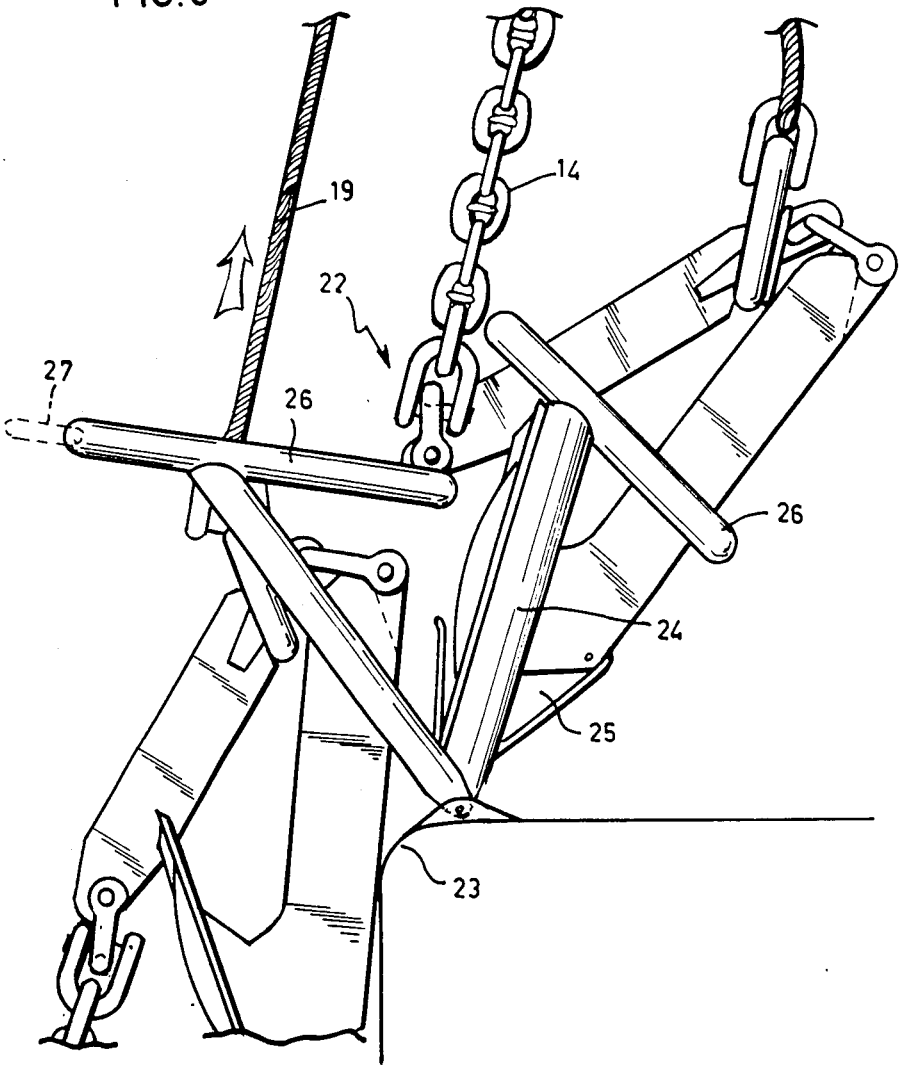

FIGS. 5*a–e* are schematic views of a number of anchors, based on the novel principle, whereas FIG. 5*f* clearly shows the penetration soil tunnel through the anchor of FIG. 5*a;* and FIG. 6 shows an anchor rack for use with an anchor with precutter.

In FIG. 1 an anchor 1 with V-shaped twin shank is illustrated, the shank legs 2, 2 of which are positioned at an angle to be determined, dependent upon the type of soil, with respect to the fluke 3, which angle is approximately 28° for hard soil and approximately 50° for soft soil.

The invention relates to the position in which the shank legs 2, 2 are placed with respect to each other on the fluke 3, which position is so that when digging-in the soil experiences little resistance and passes slidingly between the shank legs as through a tunnel, as depicted in FIG. 1 with the passing lump of soil 4, so that the anchor 1 can penetrate deeply into the ground. To that end the shank legs 2, 2 are situated in planes 5, 5 which have an intersecting line 7 parallel to the fluke axis 6, which intersecting line 7 is partially imaginary, at 7', but at the location of the anchor eye 8, where the shank legs 2, 2 meet at the top, is also partially real, as indicated by 7''. Thus the soil 4 can readily pass slidingly between the shank legs 2, 2 until the top, whereas in the prior anchors with V-shaped twin shank, particularly at the top where the shank legs at their meeting point cause an impeding effect, at penetration a high resistance was experienced so that a deep penetration could not be reached.

A rule for the positioning of the shank legs 2, 2 is that the line 9 along each of the shank legs, parallel to the fluke 3, considered in projection on the fluke, averaged along the height of the shank, makes an angle of no more than 0°±9° with the fluke axis 6, which angle preferably decreases from below to above, but measured along the height of the shank maybe constant over at least a portion of the height. Above 30% of the shank height, as measured from the fluke it is, in any event, better to satisfy the rule and to remain within the 0° to 9° limit values as the soil 4 can then more readily pass the wider passage below between the shank legs 2, 2, than through the narrow passage above under the anchor eye 8, where the anchor shackle 10 is hooked-in through the shank legs 2, 2 which meet there, and where in the prior anchors with V-shaped twin shank as stated always a strongly impeding action, exerting much resistance, is developed.

It is observed that the holding force of the anchor is defined by the product of the fluke surface area and the penetration. The penetration is a third power root function of the holding force and therefore quite strongly influences the holding force.

In prior anchors, as described in the foregoing, it is intended that the shank legs would also provide holding force so that the penetration is strongly counteracted and the holding force cannot be optimal.

The anchor 1 as illustrated in FIG. 1 has stabilizers 11, 11 in the rear corners of the fluke 3, which stabilizers due to their arrangement and plate structure practically do not form any obstruction against penetration but give the anchor an uplift at the rear lower side so that the penetration position is maintained as long as possible.

In FIGS. *2a* through *3b* a stabilizer 11 which is bent upwardly in the outward and forward directions is represented. As will be discussed in the following stabilizer 11 in the direction parallel to the fluke axis, is inclined with respect to the fluke 3 at an angle $\alpha$ of 15°–55° and in the direction perpendicular to the fluke axis is inclined at an angle $\beta$ of 0°–38°.

FIGS. *2a–f* show suitable stabilizers 11 and 11' which are also arranged at the stated angles $\alpha$ and $\beta$. The outwardly and forwardly upwardly extending inclined position of the stabilizer 11 or 11' appears to be more satisfactory than the rearwardly bent-back inclined position which is used in the afore mentioned known anchor.

The stabilizer which due to the arrangement and the plate structure presents practically no obstruction against penetration also gives the anchor an uplift at the rear lower side so that the penetration position is maintained as long as possible.

A small adjustable obstruction surface, mounted transversely on the fluke between the shank legs, can suddenly stop the anchor when reaching the desired holding force.

The stabilizer can be constructed in various ways. In FIG. *2a* the section ABCD of the fluke is tipped up about the axis AB at an angle $\alpha$ in plane ABEF, thus giving an upwardly directed force in the side, and thereby stability.

If the anchor is pulled away obliquely, for instance in the direction AF as indicated in FIG. *2a*, then the pyramid $ACEF_1$ in FIG. *2b* will be filled with specie, thus forming a proper surface to restore the stability of the anchor. This fillable section $ACEE_1$ is replaced in FIG. *2b* by a plate $ACE_1$. The stabilizer 11 of FIG. *2c* will not be more effective than that of FIG. *2b* as $ACE_1$ does not add stability in the direction of penetration.

In FIG. *2d* AC is shifted to $A_1C$, thus defining $A_1A_2E_1C$. In practice this is refined by shifting shaded surfaces to $A_1B_1E_1C$ as illustrated in the stabilizer 11' in FIG. *2e* and also in FIG. 1. All the described shapes are stabilizing, the plate being bent-up forwardly about the fluke edge $A_1C$. A stabilization surface bent-down about AV as shown in FIG. *2f* can also provide the required uplift on the lower side.

FIG. 3 shows a form of stabilizer 11'' adapted to pivot about the fluke edge 12 and dirigible by a sensor-operated actuation element 13. The sensor 13 is adapted to be controlled by a force or motion in the pulling line 14 to adjust the position of the stabilizer 11'' which is pivoted on the fluke 3, and thus exert more or less resistance and thereby control the developed holding force. The tensile force in line 14 can then be limited to prevent rupture of the line.

The illustrated stabilizer 11'' has at the leadig side an uplift promoting edge as indicated in FIG. *3a* with a detailed sectional view.

Until now stabilizers were always fixedly provided with respect to the pivotal fluke.

The action of stabilizers in general is that they give resistance at penetration. This means that if the anchor would rotate along the longitudinal axis, the stabilizer which has the greatest penetration will also meet the greatest upwardly directed force so that the anchor will be balanced again.

The stabilizers are often round and give much resistance against penetration, thus considerable loss in holding force, for a deeply penetrated anchor gives the most holding force.

The invention tends to provide a stabilizer which causes as little resistance as possible when penetrating and which when the anchor gets into a continuous slip, gives as little resistance as possible.

An additional advantage is that the stabilizer like an aileron of an aircraft wing, tends to direct the entire fluke downwardly so that the penetration movement will again be maintained as long as possible.

If the stabilizer is now mounted on the fluke at a greater angle, it can be said that thereby the penetration resistance is increased, for the pressure which the stabilizer exerts downwardly on the soil, may increase infinitely, as the soil cannot move away downwardly.

It is thus possible to control the penetration depth, and thereby the holding force, by increasing or decreasing the angle of the stabilizer.

Greater penetration and greater holding force demand as small an angle adjustment of the stabilizer as possible.

Less penetration and less holding force is achieved by means of a larger angle of the stabilizers.

The angle of the stabilizer may be influenced by means of a:

i.

a. hydraulic cylinder, b. air-operated cylinder,
c. wedge pushed or not pushed in or out hydraulically or by means of air,
d. electric motor;

the means mentioned under (i) can be controlled ii.

a. by a strain gauge in the anchor shackle,
b. by a pressure plate on the fluke,
c. by a lever which is pushed back-over,
d. radiographically or
e. during positioning and pulling-in the anchor from a ship by electric operation.

The great advantage of such holding force adjustment is that the chain, the price of which is a multiple of the price of the anchor, can be laid out at a much lower factor than the usual factor of two because at a pre-set load the anchor will slip. This provides considerable saving in the cost of the chain.

Furthermore at a maximum demanded holding force the stabilizer can be positioned so that no resistance at all is experienced when penetrating, but now a sensor mechanism will have to be built in, which responds to the rotation. If the anchor rises left wing of the angle of the right-hand stabilizer must be increased and upon reaching the balance the minimum angle is reset.

The slip can also be controlled as the portion of soil, between the fluke and the shank, anywhere substantially remains the same in cross-section. Thus a relatively small obstruction breaks up the entire "soil tunneling" effect and so the holding force is suddenly increased and the slip—the forward movement of the anchor—will stop.

An ostruction plate can be influenced by i a through c and ii a through c above as well as by an auxiliary anchor rearwardly of the anchor which activates the obstruction plate through a wire when reaching the maximum slip.

FIGS. 4*a–e* show an anchor 1 with precutter 15 and provide an illustration of the relationship to the anchor without a precutter. As illustrated in FIG. 4*f* even deeper penetration action is achieved.

FIGS. 4*a* and 4*b* show the anchor 1 and the precutter 15 collapsed when brought out, and FIGS. 4*c* through 4*e* show the unfolding and digging-in. Due to the precutter 15 in FIG. 4*e* eventually a deeper penetration position is reached than the anchor of FIG. 4*f* without precutter can achieve.

The precutter 15 consists as indicated a knife-shaped forerunner with a streamline plate 16 arranged at its rear, which enhances the onflow to the anchor shackle 10.

By the use of a precutter the holding force can be doubled.

Beside the function of aiding penetration the precutter 15 fulfils yet another important task.

Because the anchor 1 can be readily pulled out from the shackle 10, a chaser 17 can be successfully applied. To that end right ahead of the streamline plate 16 a recess 18 is made, in which the chaser 17 is caught to exert a vertical force on the shackle 10 to so break out the anchor. Now upon break-out of the anchor and the ship sailing away, the anchor will then tip from below against the precutter and lock up the chaser (FIG. 4*a*). The anchor will then move through the water upside down with the precutter 15 between the two fluke tips, with the chain 14 or cable, in stable condition. If the operating tug-boat stops and the wire 19 (pennantwire) is paid out again while the chain is tensioned the anchor automatically arrives in the right starting position (FIG. 4*b* etc.).

FIGS. 5*a–e* schematically represent a number of anchors according to the invention.

FIG. 5*a* shows an anchor with shank legs which are detachable and adjustable at various angles with respect to the fluke for hard, and soft soil, respectively. For soft soil the lashing plates 20, 20 are removed, or another bolt row is used.

FIGS. 5*b, c* show a shank with wide shank legs 2, 2 or constant width on which one or more cable eyes 8 are to be arranged and FIGS. 5*d, e* show an anchor 1 provided with one or more auxiliary flukes 21, 21 to be arranged on the shank 2, 2.

FIG. 5*f* the tunnel passage for the soil through the anchor of FIG. 5*a* is depicted. Which tunnel formation is an important feature for all the anchor embodiments represented.

In FIG. 6 an anchor rack 22 of the anchor 1 with precutter 15 is represented, with a post 24 which is tiltable about the deck edge 23 and has a cradle 25 below and a stowage ring 26 above into which the anchor 1 with the leading sides 15 folded thereagainst is lifted with the pennantwire 19, preferably through a snap lock 27.

Tests showed that an anchor efficiency (holding force-weight) of 100 (without precutter) and 200 (with precutter) can be achieved.

I claim:

1. An anchor comprising a fluke and a shank attached to the fluke, said fluke having front and rear portions, said fluke having a longitudinal axis going through a central part of the fluke in the front to rear direction, said shank having two legs being positioned to each other at an angle to define a V-shaped body, each said leg of the shank having substantially flat configuration, said legs lying in planes intersecting each other along a first line of intersection positioned at a top portion of the shank, said first line of intersection meeting the longitudinal axis of the fluke at a point lying forwardly of the fluke;

stabilizing means in the form of plate arrangements, at least one entire side of each said plate arrangement being contiguously attached at side edges of the rear portion of the fluke, said each plate arrangement being positioned to a top surface of the fluke at an angle not exceeding 180°; one entire first side of each said leg of the shank connecting the shank with the top surface of the fluke being contiguous with the top surface of the fluke;

an angle between the direction of said first side of each said leg and the longitudinal axis of the fluke is betwee 0°–9°;

a tunnel passage having a substantially constant cross-sectional area being defined between the shank legs and the fluke, said area being designed for glided penetration and displacement of a soil therethrough.

* * * * *